US005778995A

United States Patent [19]

McGarian

[11] Patent Number: 5,778,995

[45] Date of Patent: Jul. 14, 1998

[54] MILLING INSERT AND A MILLING TOOL

[75] Inventor: Bruce McGarian, Aberdeen, Scotland

[73] Assignee: The Red Baron (Oil Tools Rental) Ltd., Aberdeen, Scotland

[21] Appl. No.: 651,794

[22] Filed: May 21, 1996

[51] Int. Cl.[6] ..... E21B 10/36

[52] U.S. Cl. ..... 175/420.1; 175/428

[58] Field of Search ..... 166/55, 55.7; 175/420.1, 175/426, 428, 430

[56] References Cited

U.S. PATENT DOCUMENTS

| | | | |
|---|---|---|---|
| 4,710,074 | 12/1987 | Springer | 408/200 |
| 5,035,546 | 7/1991 | Pawlik | 407/116 |
| 5,070,952 | 12/1991 | Neff | 166/55.7 |
| 5,193,944 | 3/1993 | Nishimura | 407/53 |
| 5,215,415 | 6/1993 | Fukuoaka | 407/116 |
| 5,425,603 | 6/1995 | Dutschke et al. | 407/40 |

FOREIGN PATENT DOCUMENTS

| | | | |
|---|---|---|---|
| 0515004 | 11/1992 | European Pat. Off. | E21B 29/00 |
| 4127509 | 4/1992 | Germany | B23C 5/20 |
| 681211 | 2/1993 | Switzerland | B23C 5/20 |
| 2164883 | 4/1986 | United Kingdom | B23C 5/20 |
| 2180177 | 3/1987 | United Kingdom | B23B 27/16 |
| 2233588 | 1/1991 | United Kingdom | B23C 5/20 |
| 2270097 | 3/1994 | United Kingdom | E21B 29/00 |
| 2280692 | 2/1995 | United Kingdom | E21B 29/00 |

*Primary Examiner*—Roger J. Schoeppel
*Attorney, Agent, or Firm*—Harrison & Egbert

[57] ABSTRACT

A cutting insert for use on a milling machine including an element formed of hard material, such as carbide. The element defines a rear face, by means of which it may be mounted in position, and a front face. The front face defines, towards its lower edge, a cutting projection defining a single leading cutting edge. The front face defines a surface, which may be a curved surface, which extends rearwardly and upwardly from the cutting edge. When the cutting insert is located in abutment with an adjacent cutting insert, the upper edge of the planar front face is located immediately adjacent a forwardly extending part of the undersurface of the cutting projection of the next adjacent cutting insert.

10 Claims, 2 Drawing Sheets

FIG 1
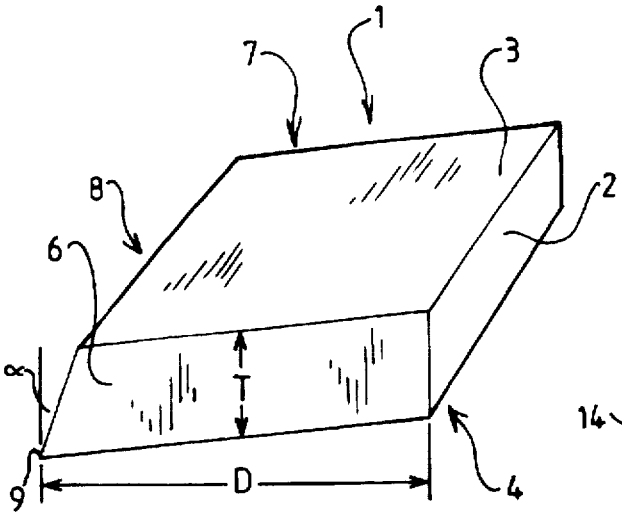
FIG 3
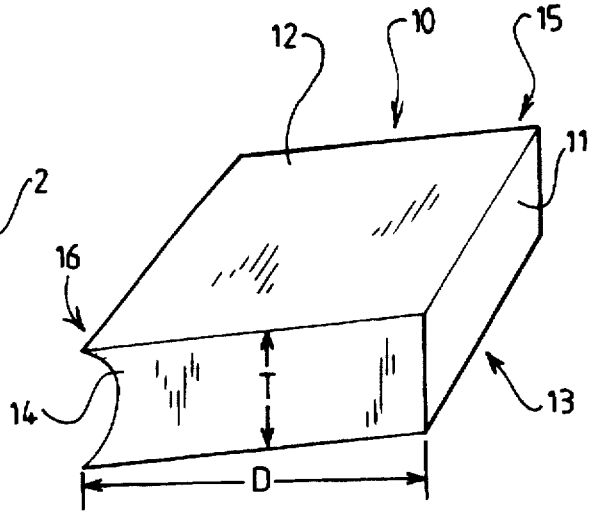
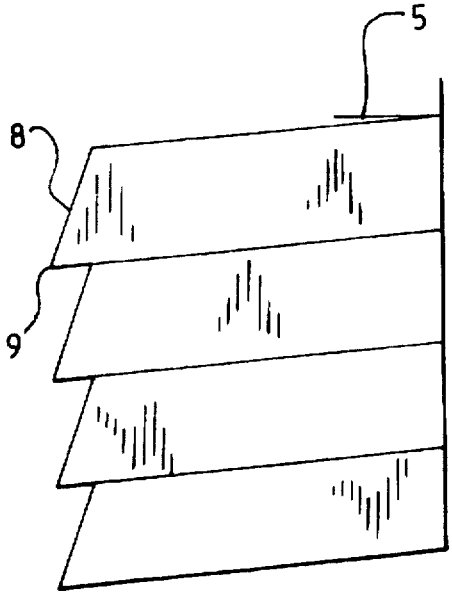
FIG 2
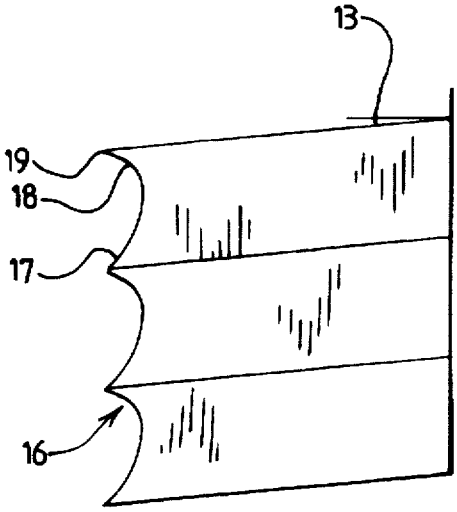
FIG 4

MILLING INSERT AND A MILLING TOOL

TECHNICAL FIELD

The present invention relates to a milling insert and to a milling tool which utilises the insert. In particular, the invention relates to a milling insert and a milling tool of particular use in down-hole operations in the oil and gas industry.

BACKGROUND ART

Many proposals have been made concerning the provision of different types of "insert" for use on a milling tool. The insert is typically an element made of very hard material, such as tungsten carbide, which is secured to a blade of a milling tool, the insert actually cutting the metal that is to be milled away by the tool.

Very particular requirements exist in connection with cutting inserts intended for use on mills for use "down-hole". While, of course, it is desirable that the mill should operate as swiftly as possible, thus cutting away the maximum amount of metal in minimum time, the swarf (or cuttings) produced by the mill must be such that it can readily be carried out of the hole by the mud that flows through the hole. It is undesirable for the swarf (or cuttings) to be too long, since otherwise the swarf may form "bird's nests", which can give rise to significant difficulties.

In either event, all of the cutting edges remaining on the insert will subsequently no longer be available to effect cutting.

It is also desirable to provide a mill which can operate with the expenditure of a minimum amount of energy.

It has been proposed to provide a mill in which a specific type of cutting insert is provided. The cutting insert presents a front or operative face which is provided with a plurality of substantially parallel transversely extending projections. Each projection is substantially of triangular form in cross-section and thus each transversely extending projection effectively forms a cutting edge. The lowermost projection provided on the cutting insert is the first part of the insert to come into contact with the metal to be cut. The swarf generated by the cutting process moves along the upper face defined by the triangular projection, but is then broken off on reaching the underface of the next projection. Thus, the length of the swarf is restricted.

As the lowermost cutting edge is worn away, the next cutting edge comes into operation.

A disadvantage of the prior proposal is that if the cutting edge encounters an irregularity, so that a shock is imparted to the cutting element, there is a risk that the entire cutting element may become dislodged from the mill. Alternatively, the cutting element may split or delaminate. A consequence of this may be that the exposed part of the cutting element, i.e. the part defining the transverse cutting edges, is no longer available to effect cutting.

The present invention seeks to provide an improved cutting insert and a mill incorporating the improved cutting insert.

SUMMARY OF THE INVENTION

According to this invention there is provided a cutting insert for use on a mill, the cutting insert comprising an element formed of a hard material, the element defining a rear face, by means of which the element may be mounted in position, and a front face, the front face defining, towards its lower edge, a cutting projection, defining a leading single cutting edge, the front face defining a surface which extends rearwardly and upwardly from the cutting edge, the element defining upper and lower faces, the thickness of the insert between the upper and lower faces being between 0.187 and 0.22 cms.

Preferably the front face is substantially planar, the arrangement being such that when the cutting insert is located in abutment with adjacent cutting inserts, the upper edge of the planar front face is located immediately adjacent a forwardly extending part of the undersurface of the cutting projection of the next adjacent cutting insert.

Conveniently the front face of the projection makes an angle of approximately 19° with the plane defined by the rear face of the insert. Alternatively the upper part of the front face of the insert is of arcuate form.

Conveniently the upper part of the front face of the cutting insert is of arcuate form with a radius of curvature which gradually shortens.

Advantageously the front face terminates with a upper forwardly projecting protrusion.

Preferably the upper face and the lower face of the insert are inclined at an angle of approximately 5° to the perpendicular to the plane defined by the rear face of the cutting insert.

Advantageously the depth of the insert is approximately 0.62 to 0.635 cms.

The invention also relates to a mill, the mill comprising a body carrying a plurality of blades, the blades each carrying a plurality of cutting inserts as defined above in a regular array, with the underface of one insert substantially abutting the upper face of the next adjacent insert.

The blades are preferably fixed blades which extend radially outwardly from the body, but the blades may be pivotally mounted blades. The blades may be aligned with the axis of the body or may exhibit a negative rake, typically of approximately 10° relative to the axis of the mill. The cutting inserts may be brazed to the blades.

BRIEF DESCRIPTION OF THE DRAWINGS

In order that the invention may be more readily understood, and so that further features thereof may be appreciated, the invention will now be described, by way of example, with reference to the accompanying drawings in which:

FIG. 1 is a perspective view of one cutting insert in accordance with the invention, FIG. 2 is a side view of a plurality of cutting inserts of FIG. 1 when located adjacent each other, FIG. 3 is a perspective view of an alternative form of cutting insert in accordance with the invention, FIG. 4 is a side view showing a plurality of cutting inserts of the type shown in FIG. 3 located adjacent one another.

DETAILED DESCRIPTION OF THE INVENTION

Figure 5:
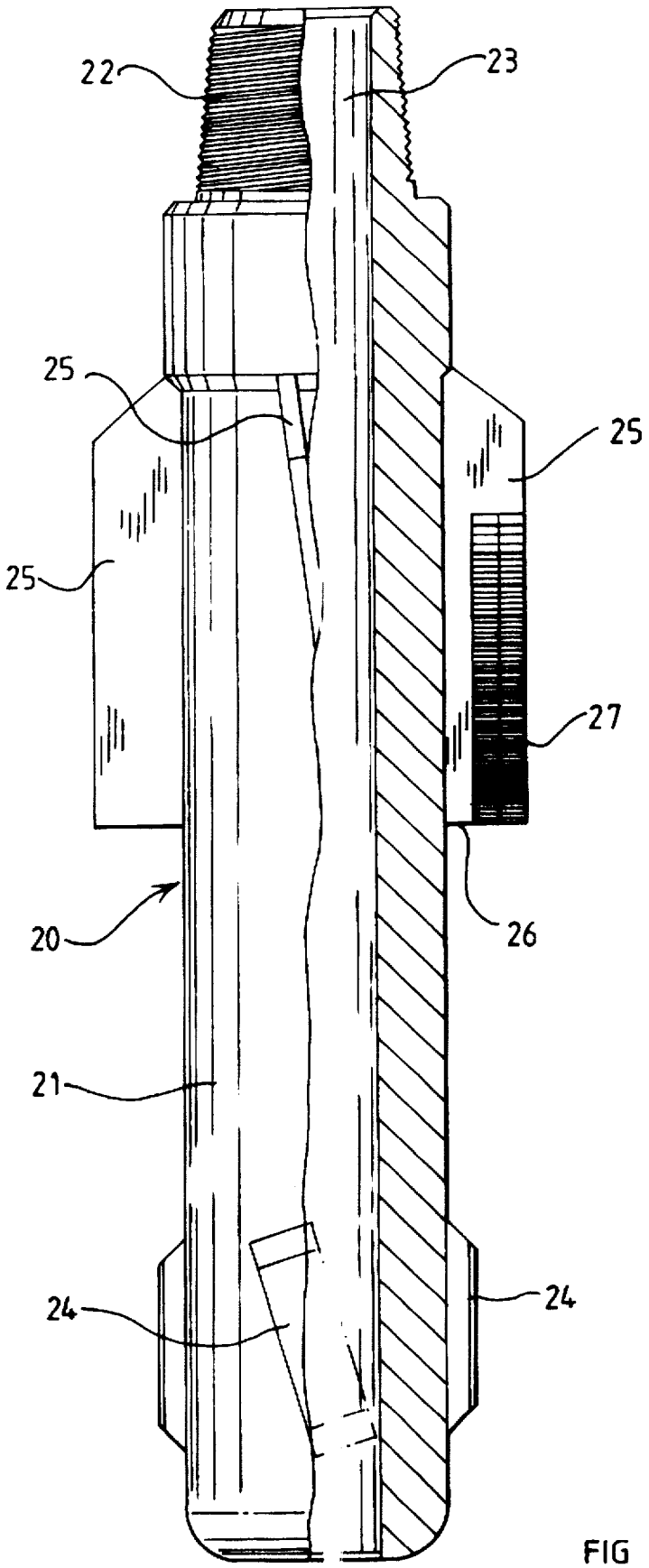
FIG. 5 is a side view, with parts cut away, of a mill provided with cutting inserts of the type shown in FIGS. 1 and 2.

Referring initially to FIGS. 1 and 2 of the drawings, one embodiment is a cutting insert in accordance with the invention comprises an element 1 made of a very hard material such as, for example, tungsten carbide. The insert may be made in a conventional way, but the insert is made to have a novel shape and configuration as will now be described.

The insert comprises a substantially cuboidal block of hard material. The rear face 2 of the block, which is a vertical face in the orientation illustrated, is substantially planar and is used, as will be described hereinafter, for mounting the block in position. The top face 3 and the underface 4 of the block are parallel with each other but are not perpendicular to the plane defined by the rear face 2 of the block. The top face 3 and the underface 4 are downwardly inclined from a perpendicular to the rear face at an angle 5 (see FIG. 2) which is approximately 5°.

The side faces 6 and 7 of the block are parallel and extend perpendicularly to the plane defined by the rear face 2.

The front face 8 of the block is a substantially planar face inclined at an angle to the plane defined by the rear face 2 by an angle 9 which approximately 19°.

The lower part of the front face 8 thus forms a cutting projection, defining a leading single cutting edge. The front face 8 forms a surface which extends rearwardly and upwardly from the cutting edge.

As can be seen from FIG. 2, a plurality of cutting inserts 1 of the type illustrated in FIG. 1 may be located adjacent each other, with the rear faces 2 of the blocks being aligned to be co-planar, the upper face 3 of one insert being located substantially at abutment with the lower face 4 of the next adjacent insert. The upper edge of the planar front face 8 of the lower insert is located immediately adjacent a forwardly extending part of the underface of the cutting projection of the next adjacent cutting insert.

The overall thickness (T) of the block shown in FIG. 1 may be 0.187 cms (0.074 inches), and the total depth (D) may be 0.635 cms (0.250 inches).

FIG. 3 illustrates an alternative form of cutting insert for use in accordance with the invention. The cutting insert 10 shown in FIG. 3 is again in the form of an element made of very hard material, such as tungsten carbide. The insert may again be made in a conventional way, but is made to have a novel shape and configuration.

Again the insert comprises a substantially cuboidal block of the hard material having a rear face 11 which is substantially vertical in the orientation illustrated. The insert 10 has a top face 12 and an underface 13 which are parallel with each other, but which are not perpendicular to the plane defined by the rear face 11 of the block. The top face and the underface are inclined downwardly, relative to a perpendicular from the rear face, at an angle 13 (see FIG. 4) which is approximately 5°. The insert has side faces 14,15 which are parallel and which extend perpendicularly to the plane defined by the rear face.

The front face 16 of the block is of an arcuately recessed form. The block thus defines a lower cutting projecting portion 17 which defines a single leading cutting edge, which is initially of substantially planar form but subsequently curves 18 with a radius of curvature which gradually shortens to form an upper forwardly projecting protrusion 19.

It can be seen that when the cutting inserts, as described, are superimposed, as shown in FIG. 4, with the underface 13 of one cutting insert located in abutment with the upper face 12 of the next adjacent insert, the upper protrusion 19 of one insert is substantially aligned with the lower projection 17 of the next adjacent insert. A cutting insert as shown in FIGS. 3 and 4 may have a thickness (T) of approximately 0.22 cms (0.087 inches) and may have a depth (D) of approximately 0.62 cms (0.247 inches).

A plurality of inserts as described with reference to FIGS. 1 and 2, in the orientation shown in FIG. 2, may be mounted on a mill 20 as shown in FIG. 5. It is to be understood that alternatively a plurality of the inserts 10 as described with reference to FIGS. 3 and 4, in the orientation shown in FIG. 4, may be mounted on a mill in a directly corresponding manner.

The mill 20 comprises a generally cylindrical body 21 provided, at its upper end, with the threaded pin 22 to enable the body to be connected to another part of a drilling string, as is conventional. As is also conventional, the body is provided with a central flow passage 23 for mud or other drilling fluid.

The body is provided, adjacent its lower end, with a plurality of stabilizer blades 24 of a conventional design. The body is provided, towards its upper end, with a plurality of substantially radially outwardly directed cutter blades 25, these blades having a slight negative rake, approximately 10°, with regard to the axis of the body. It is to be appreciated that in an alternative embodiment each blade may be aligned with the axis of the body.

Each cutter blade has a substantially radially outwardly extending lower surface 26 comprising a cutter surface.

Mounted on the front face of each blade 25 is a regular array 27 of cutting inserts 1 as shown in FIG. 1, with the inserts being located adjacent each other, in the manner illustrated in FIG. 2. The rear face 2 of each cutting insert is welded or brazed to the blade 25.

In performing the brazing process, initially steps are taken to ensure that the blade 25 and the cutting inserts 1 are clean and free from grease or oil. The front face of the blade 25 is coated with flux paste, as is the rear face of each of the carbide inserts. The fluxed carbide inserts are placed on to the fluxed face of the blade. Heat is then applied to the opposite side of the blade 25 using an appropriate gas burner nozzle.

When the flux is seen to be molten, the joint area is at a temperature of about 600°. An appropriate hand torch may then be used to heat the tungsten carbide elements and an appropriate brazing material, such as a silver brazing material, may be brought into contact with the heated joint area. The brazing material is melted by heat conducted from the blade and from the cutting inserts, rather than being melted by direct application of flame from the hand torch.

Alternatively, after applying flux to the blade, a clean sheet of an appropriate foil of brazing metal may be applied to the fluxed blade before the fluxed cutting inserts are applied to the fluxed blade. If this procedure is adopted, when the blade is heated to an appropriate temperature, the foil will melt. If this procedure is utilized, it is appropriate for steps to be taken to ensure that the inserts do not move when the flux melts and the silver brazing material flows.

After the brazing process has been completed, the cutting inserts are to be cleaned so that no flux or other material is present on the cutting face.

It is found that when a mill of this type is used, the swarf or cuttings that are generated are relatively cool, as compared with the temperature of cuttings produced by a significant proportion of the prior art mills. It is also found that less power has to be provided to the mill to provide a predetermined cutting effect. It is found that the cuttings or swarf generated by the mill, when cutting a typical pipe as found downhole in an oil or gas well, are relatively short, typically being of the order of 1 millimeter long. It is believed that this is caused by the relative spacing between the various protrusions or cutting edges present on the front of the abutted cutting inserts. In the arrangement as shown in FIG. 2, the spacing between the various cutting edges is equivalent of the thickness (T) of the insert (and a similar comment applies to the spacing between the cutting edges of the insert 10 as shown in FIGS. 3 and 4).

It is believed that the swarf cut travels up the inclined face 8 and is deflected when reaching the underface 4 of the next adjacent cutting insert. The bent swarf curls over and breaks when a sufficient bending moment is imparted to the swarf. The swarf may effectively coil over until the swarf re-contacts the pipe being cut. The swarf then snaps off. With the insert 10 as shown in FIGS. 3 and 4, the swarf travels initially up the inclined face of the lower protrusion 17 and is then deflected when reaching the curved portion 18 which leads to the upper projection 19. The swarf thus curls over and breaks.

It is to be noted that if a cutting edge which is operative is subjected to a severe shock due, for example, to an irregularity in the item being cut, only the cutting insert 1 carrying that cutting edge will be dislodged from the tool. The remaining inserts will stay in position. The next adjacent cutting edge will thus relatively swiftly be brought into operation. While not wishing to be bound by any theory the applicant believes that some of the brazing material, in this example, a silver alloy, is located between the individual cutting inserts, and forms a shock absorbing material. The silver alloy is not as hard and unyielding as the tungsten carbide, and if the cutting insert is subjected to a shock it is better able to withstand the shock, due to the relatively small size of the cutting insert, and the shock absorbing brazing material.

What is claimed is:

1. A cutting insert for use on a mill, the cutting insert comprising:

a first element formed of a hard material, said first element defining a rear face by means of which said first element can be mounted in position, and said first element defining a front face having a cutting projection towards a lower edge thereof, said cutting projection having a leading single cutting edge, said front face defining a surface which extends rearwardly and upwardly from said cutting edge, said first element defining upper and lower faces with a thickness therebetween of between 0.187 and 0.22 centimeters, said front face being substantially planar; and a second element in abutment with said first element, said second element defining a forwardly extending part of an undersurface of a cutting projection thereof, said first element having an upper edge of said front face located immediately adjacent said forwardly extending part.

2. The cutting insert according to claim 1 wherein the front face of the cutting projection of said first element forms an angle of approximately 19° with a plane defined by the rear face of said first element.

3. The cutting insert according to claim 1 wherein the upper face and the lower face of said first element are inclined at an angle of approximately 5° to perpendicular to a plane defined by the rear face of the first element.

4. The cutting insert according to claim 1 wherein a depth of the first element is approximately 0.62 to 0.635 cms.

5. A mill comprising:

a body carrying a plurality of blades, each of the plurality of blades carrying a plurality of cutting inserts in a regular array, said plurality of cutting inserts comprising:

a first insert formed of a hard material, said first insert defining a rear face by means of which said first insert is mounted in said plurality of blades, said first insert defining a front face having a cutting projection at a lower edge thereof, said cutting projection having a leading single cutting edge, said front face defining a surface which extends rearwardly and upwardly from said cutting edge, said first insert defining upper and lower faces with a thickness therebetween of between 0.187 and 0.22 centimeters, said front face being substantially planar; and a second insert in abutment with said first insert, said second insert having an underface substantially abutting said upper face of said first insert, said first insert having an upper edge of said front face located immediately adjacent a forwardly extending part of said underface of said second insert.

6. The mill according to claim 5 wherein the blades are fixed blades which extend radially outwardly from the body.

7. The mill according to claim 6 wherein the blades are substantially aligned with an axis of the mill.

8. The mill according to claim 6 wherein the blades exhibit a negative rake relative to an axis of the mill.

9. The mill according to claim 8 wherein the blades exhibit a negative rake of approximately 10° relative to the axis of the mill.

10. The mill according to claim 5 wherein the cutting inserts are brazed to the blades.

* * * * *